US009228757B2

(12) United States Patent
Helt

(10) Patent No.: US 9,228,757 B2
(45) Date of Patent: Jan. 5, 2016

(54) HEATER INTERLOCK CONTROL FOR AIR CONDITIONING SYSTEM

(71) Applicant: Trane International Inc., Piscataway, NJ (US)

(72) Inventor: Robert Wayne Helt, Westborough, MA (US)

(73) Assignee: Trane International Inc., Piscataway, NJ (US)

( * ) Notice: Subject to any disclaimer, the term of this patent is extended or adjusted under 35 U.S.C. 154(b) by 0 days.

(21) Appl. No.: 14/251,223

(22) Filed: Apr. 11, 2014

(65) Prior Publication Data

US 2014/0219642 A1 Aug. 7, 2014

Related U.S. Application Data

(62) Division of application No. 11/728,632, filed on Mar. 27, 2007, now Pat. No. 8,746,584.

(51) Int. Cl.
*F24H 3/00* (2006.01)
*F24D 19/10* (2006.01)

(52) U.S. Cl.
CPC ..... *F24H 3/002* (2013.01); *F24D 19/1009* (2013.01)

(58) Field of Classification Search
CPC ..... F24H 3/002
See application file for complete search history.

(56) References Cited

U.S. PATENT DOCUMENTS

| | | | |
|---|---|---|---|
| 1,510,169 | A | 9/1924 | Aikman |
| 1,991,280 | A | 2/1935 | Hynes |
| 2,210,852 | A | 8/1940 | Falkenberg |
| 2,212,239 | A | 8/1940 | Komroff et al. |
| 2,934,323 | A | 4/1960 | Burke |
| 2,937,803 | A | 5/1960 | Cunningham |
| 2,953,355 | A | 9/1960 | Hungate |
| 3,540,526 | A | 11/1970 | Hoaglund et al. |
| 3,912,162 | A | 10/1975 | Bauer et al. |
| 4,307,775 | A | 12/1981 | Saunders et al. |
| 4,329,138 | A | 5/1982 | Riordan |
| 4,373,662 | A | 2/1983 | Bassett et al. |
| 4,421,268 | A | 12/1983 | Bassett et al. |

(Continued)

FOREIGN PATENT DOCUMENTS

| | | | | |
|---|---|---|---|---|
| EP | 188972 | A1 * | 7/1986 | ..... F24H 9/20 |
| JP | 2003163069 | A | 6/2003 | |
| KR | 940000136 | B1 | 1/1994 | |

OTHER PUBLICATIONS

Siskind, Charles S., "Electrical Control Systems in Industry", McGraw-Hill Book Company, Inc., New York, 1963, 496 pages.

*Primary Examiner* — Alissa Tompkins
*Assistant Examiner* — Phillip E Decker
(74) *Attorney, Agent, or Firm* — Conley Rose, P.C.; J. Robert Brown, Jr.; Michael J. Schofield

(57) ABSTRACT

A method is provided for controlling operation of electrical heating elements in a heating, ventilating, and air conditioning (HVAC) system in accordance with fan operating conditions, the method comprising the steps of: monitoring speeds at which a fan motor is operating; communicating status signals indicative of fan motor operating speeds; and upon receiving a status signal indicating the fan motor is operating at a speed exceeding a predetermined maximum speed, communicating a control signal instructing a heater interlock to interrupt power supplied to at least one electrical heating element.

18 Claims, 2 Drawing Sheets

(56) References Cited

U.S. PATENT DOCUMENTS

| | | | | |
|---|---|---|---|---|
| 4,474,227 | A | 10/1984 | Reedy | |
| 4,476,920 | A | 10/1984 | Drucker et al. | |
| 4,518,116 | A | 5/1985 | Grant | |
| 4,648,551 | A | 3/1987 | Thompson et al. | |
| 4,688,547 | A | 8/1987 | Ballard et al. | |
| 4,795,088 | A * | 1/1989 | Kobayashi et al. | 236/49.3 |
| 4,845,341 | A | 7/1989 | Rae | |
| 4,896,828 | A | 1/1990 | Peitz, Jr. | |
| 5,337,574 | A | 8/1994 | Dick | |
| 5,397,970 | A | 3/1995 | Rowlette et al. | |
| 5,488,218 | A | 1/1996 | Olsen | |
| 5,619,112 | A | 4/1997 | Younessi et al. | |
| 6,002,114 | A * | 12/1999 | Lee | 219/501 |
| 6,089,310 | A | 7/2000 | Toth et al. | |
| 6,326,930 | B1 | 12/2001 | Jones | |
| 6,353,303 | B1 | 3/2002 | Ramachandran et al. | |
| 6,423,118 | B1 | 7/2002 | Becerra et al. | |
| 6,925,999 | B2 | 8/2005 | Hugghins et al. | |
| 7,161,316 | B2 | 1/2007 | Archer et al. | |
| 7,177,534 | B2 * | 2/2007 | Jones et al. | 392/360 |
| 7,332,019 | B2 | 2/2008 | Bias et al. | |
| 7,381,028 | B2 | 6/2008 | Hancock et al. | |
| 7,434,744 | B2 | 10/2008 | Garozzo et al. | |
| 7,601,204 | B2 | 10/2009 | Woodruff et al. | |
| 2005/0006488 | A1 | 1/2005 | Stanimirovic | |
| 2005/0082277 | A1 | 4/2005 | Jones et al. | |
| 2005/0258259 | A1 | 11/2005 | Stanimirovic | |
| 2006/0049268 | A1 | 3/2006 | Weimer et al. | |
| 2006/0130663 | A1 | 6/2006 | Joshi et al. | |
| 2006/0185373 | A1 | 8/2006 | Butler et al. | |
| 2007/0039462 | A1 * | 2/2007 | Helt et al. | 95/6 |
| 2007/0095082 | A1 * | 5/2007 | Garrett et al. | 62/180 |
| 2008/0223944 | A1 | 9/2008 | Helt et al. | |
| 2009/0090115 | A1 | 4/2009 | Boydstun et al. | |
| 2011/0073159 | A1 | 3/2011 | Shen et al. | |

* cited by examiner

HEATER INTERLOCK CONTROL FOR AIR CONDITIONING SYSTEM

CROSS-REFERENCE TO RELATED APPLICATIONS

The present application is a divisional of and claims priority to U.S. Non-Provisional patent application Ser. No. 11/728,632 filed on Mar. 27, 2007 by Robert W. Helt and entitled "Heater Interlock Control for Air Conditioning System," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In certain types of heating, ventilating and air conditioning (HVAC) equipment, electric heating elements are incorporated in the equipment in combination with a motor driven blower and, possibly, a cooling type heat exchanger, such as an evaporator coil for a vapor compression cooling circuit or heat pump circuit. One problem associated with utilizing electric heating elements in an air conditioning system of the general type mentioned herein is the requirement to provide for positive shut-off of the electric heating elements if the system blower or air circulation fan motor is operating in a range of operating conditions which will result in hazardous heat buildup. For example, if the blower or circuiting fan motor is operating at a relatively low speed, or has shut-off for any reason, unwanted and rapid heat buildup or overheating of the system may occur.

Moreover, regulatory requirements for air conditioning systems which utilize electric heating elements can result in extensive testing for various blower or air circulating fan motor operating conditions. However, if a system control can be provided which would block or interrupt power to the electric heating elements when the blower or circulating fan motor was operating outside of a predetermined range of operating conditions, regulatory testing requirements could be reduced, system reliability increased and the chance of a hazardous operating condition could be avoided. It is to these ends that the present system has been developed.

SUMMARY

The present disclosure in one embodiment provides a method for operating an air conditioning apparatus, said apparatus including a cabinet, an air blower including an electric blower motor for propelling air from an air inlet to an air outlet of said cabinet, and at least one electric heating element disposed in an air flowstream propelled by said blower through said cabinet, said apparatus further comprising a first temperature sensor for sensing the temperature of an enclosed space being supplied with conditioned air by said apparatus and a control system including a system controller operably connected to said first sensor, and to a second temperature sensor for sensing the temperature of air being discharged from said apparatus, said control system further including a heater interlock operable to prevent energization of said heating element, said method including the steps of: monitoring at least one of an operating condition of said blower motor and a limit temperature of air being circulated by said blower; and causing said heater interlock to prevent energization of said heating element dependent on one of said operating condition and said limit temperature.

The present disclosure as provide a method for controlling operation of electrical heating elements in a heating, ventilating, and air conditioning (HVAC) system in accordance with fan operating conditions, the method comprising the steps of: monitoring speeds at which a fan motor is operating; communicating status signals indicative of fan motor operating speeds; and upon receiving a status signal indicating the fan motor is operating at a speed exceeding a predetermined maximum speed, communicating a control signal instructing a heater interlock to interrupt power supplied to at least one electrical heating element.

Those skilled in the art will further appreciate the above-mentioned advantages and features of the present system and method, together with other important aspects thereof upon reading the detailed description which follows in conjunction with a drawing.

DETAILED DESCRIPTION

Figure 1:
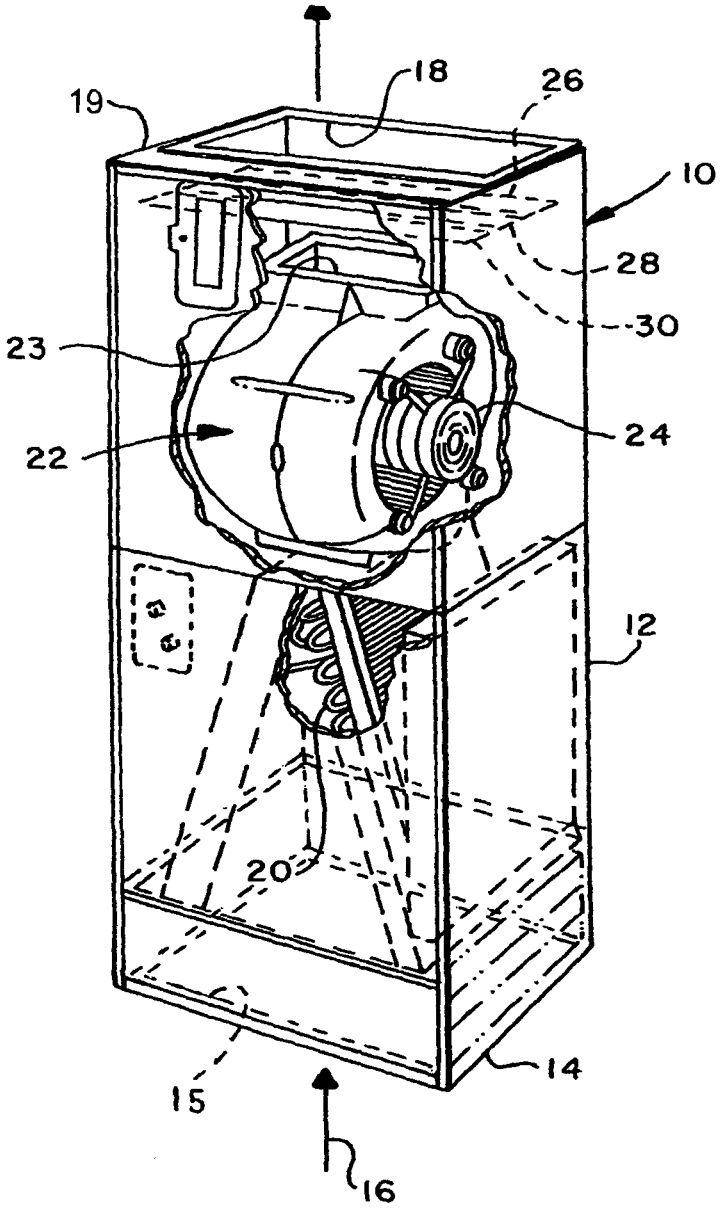
FIG. 1 is perspective view of an air conditioning apparatus utilizing a control system and method in accordance with the present disclosure.

In the description which follows, like parts are marked throughout the specification and drawing with the same reference numerals, respectively. The drawing figures and elements thereof may be in somewhat generalized or schematic form in the interest of clarity and conciseness.

Referring to FIG. 1, there is illustrated an air conditioning apparatus 10, commonly known in the art as an air handler. The apparatus 10 comprises a substantially rectangular hollow cabinet 12 and is arranged as an upflow type apparatus wherein a bottom wall 14 of the cabinet 12 has a suitable large opening 15, see FIG. 2 also, to allow air flow in a generally upward direction, as indicated by arrow 16. Air flows from bottom wall 14 upwardly and out through an opening 18 in a transverse top wall 19.

Within cabinet 12 there is disposed a suitable heat exchanger, such as an air conditioning or cooling coil 20, disposed between the aforementioned air inlet opening and an air circulating fan or blower 22. Blower 22 is driven by a suitable electric motor 24 which may be controlled in accordance with description that follows herein and in accordance with the disclosure. Air conditioning apparatus 10 also includes additional heat exchangers or heating means comprising electric resistance grid type heaters or heating elements 26, 28 and 30 which are illustrated three in number by way of example. One or more electric heaters may be utilized in an air conditioning control system and method in accordance with the disclosure. Electric heaters 26, 28 and 30 are disposed between an outlet opening 23 of blower 22 and the cabinet air outlet opening 18, FIG. 1

In the manufacture of air handlers or air conditioning apparatus of the general type illustrated and described, various types of blower drive motors may be utilized, including variable speed motors with serial communication, that is, communication between the blower motor and a controller may be by way of a four-wire interface and the air handler controller may include a microprocessor which will signal the desired blower speed required to satisfy the demand for conditioned air flowing through the cabinet 12 to an enclosed space. The motor 24 may also be a so-called constant torque type motor whereby the aforementioned controller may be set to select a constant torque setting from a plurality of available settings. The aforementioned air handler controller typically provides a suitable signal to the desired motor input connection. Still further, the motor 24 may be a so-called PSC (permanent split capacitor) motor whereby the controller may select one of three motor speeds and provide a signal for controlling the operation of one or more relays.

Figure 2:
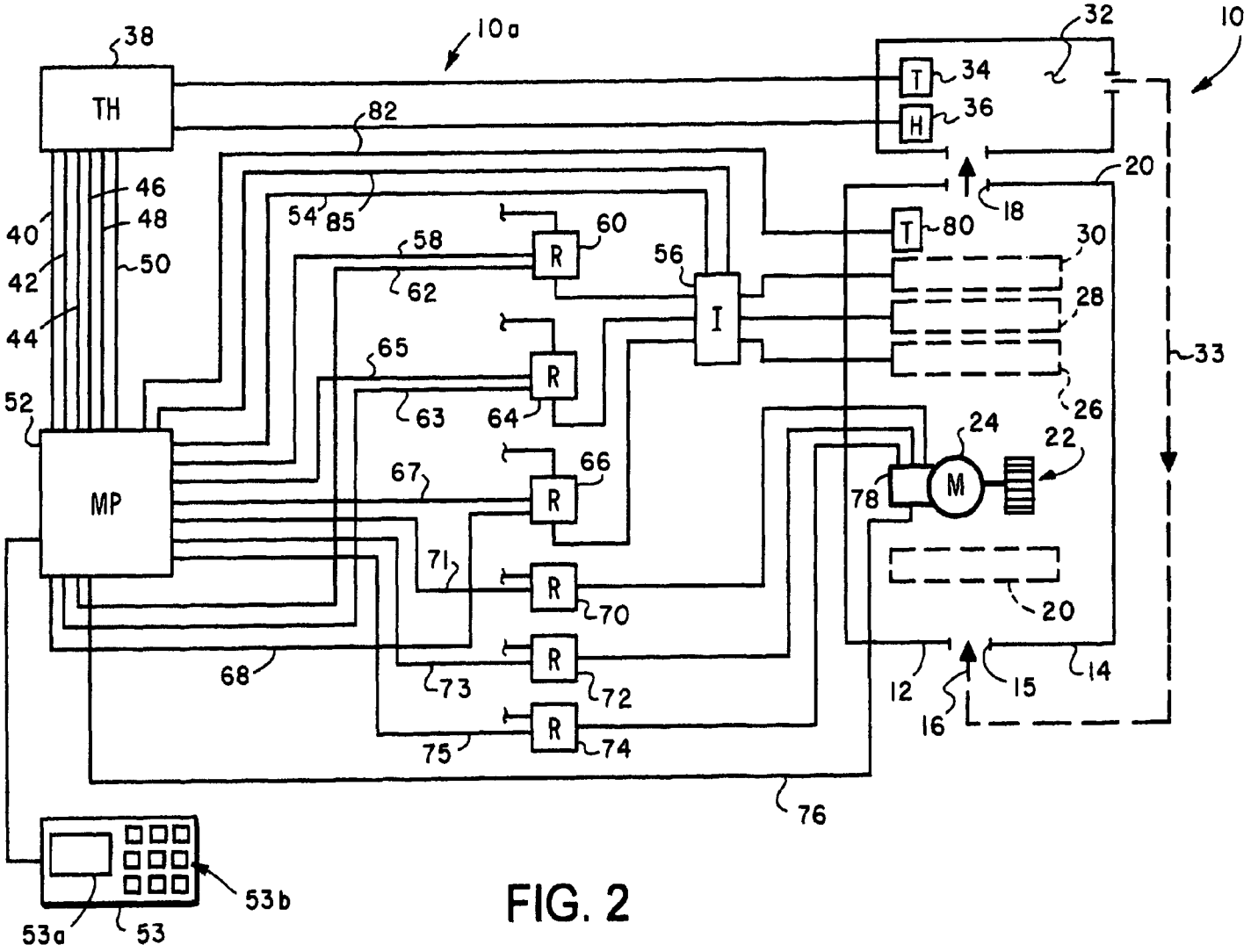
FIG. 2 is schematic diagram illustrating major components of a control system in accordance with the present disclosure.

Referring now to FIG. 2, the apparatus 10 is illustrated somewhat schematically and associated with a control system 10*a*for providing conditioned air to an enclosed space 32 from which conditioned air may be returned to the apparatus 10 via suitable duct means, as indicated by the dashed line 33. A temperature sensor 34 and a humidity sensor 36 may be disposed in the air conditioned space 32 and suitably connected to a thermostat control device 38 which is provided with low voltage power in a conventional manner. Thermostat 38 may also provide output signals via respective conductors, including a first stage heating output signal via conductor 40, a second stage heating output signal via a conductor 42, a third stage heating output signal via a conductor 44, at least a first cooling stage output signal via a conductor 46, a continuous fan operating mode signal via a conductor 48 and, possibly, a heat pump operating signal via a conductor 50. Alternatively, serial or parallel digital communication signals may be sent between thermostat 38 and a controller described hereinbelow. The control system 10*a*and apparatus 10 illustrated in FIG. 2 would, typically, include a vapor compression compressor and condenser unit, not shown, operably connected to the evaporator or cooling coil 20 and configured for either cooling only or, possibly, heat pump operation. The output signals conducted from thermostat 38 are input to a microcontroller for the system 10*a*, generally designated by the numeral 52. Microcontroller 52 may be of a type commercially available, such as a Model AT Mega 128 commercially available from Atmel Corporation, San Jose, Calif. A suitable human operable interface 53 including a visual display 53*a* and control and/or configuration command input means 53*b* may also be operably connected to microcontroller 52. Microcontroller 52 is provided with suitable electric power from a source which may also supply power to the thermostat 38, but not shown in the drawing, such a source being well known to those skilled in the art.

Referring further to FIG. 2, microcontroller 52 provides output signals by way of respective conductors as follows. Conductor 54 provides a heater interlock relay signal to a heater interlock relay 56. Output signal conductor 58 provides a control signal to a heater relay 60 connected to heater 30 by way of the relay 56. A status signal indicating the condition of relay 60 may be input to microcontroller 52 via conductor means 62.

In like manner, second and third stage heaters 28 and 26 are operably connected to respective relays 64 and 66 which receive control signals from the microcontroller 52 by way of conductors 65 and 67, respectively. Relay status signals are returned to the microcontroller by way of conductors 63 and 68, as indicated. Assuming that a PSC type motor is the embodiment of the motor 24 shown in FIG. 2, suitable motor control relays 70, 72 and 74 may be provided with control signals by way of conductors 71, 73 and 75 whereby the microcontroller 52 may command operation of the blower motor 24 at selected speeds. An input signal to the microcontroller 52 may be provided by way of a conductor 76 which is connected to a motor controller 78 which also receives operating signals from the relays 70, 72 and 74 for operating the motor 24 at the selected speed.

Although the specific configuration of the motor control circuit 78 and the associated relays 70, 72, and 74 illustrated in FIG. 2 may be that for a PSC motor, control signals on conductors 71, 73 and 75 may be sent directly to motor controller 78 to set a motor speed control signal or a motor torque control signal commensurate with the air flow demand for the conditions which exist as determined by the sensors 34 and/or 36, for example. The microcontroller 52 may, for example, issue a message to the blower motor controller 78 to set the control mode and receive a status signal of motor speed in return, set motor speed and receive a torque signal, set motor torque and request a demand signal, set air flow demand and request direction of rotation of the blower motor, set demand ramp time and request status of the demand ramp rate, set motor torque percent and request status regarding the air flow limit, and set blower coefficients. Air flow limits may also be set by the microcontroller 52 via the motor controller 78, for example.

The system 10*a* may be preset to operate in the selected mode depending somewhat on the type of motor 24 being used and including the types of motors described hereinbefore. However, for variable speed motors and variable torque motors certain limits are required to be set within and controlled by the microcontroller 52. For motor speeds above and below the preset limit speeds, for example, the heaters or heating elements 26, 28 and 30 are not allowed to operate. For example, if the motor 24 is not energized, if a motor control relay 70, 72, and 74 is not in a condition commanded by the controller 52, or if the motor 24 is not producing a torque commanded by the controller 52, the controller 52 will send a signal to the heater interlock 56 to prevent conducting electrical power to the heating elements 26, 28 and 30, even if any one of relays 60, 64 or 66 is closed, thereby causing said heater interlock 56 to prevent energization of the heating elements 26, 28 and 30 if said blower motor is not rotating. Still further, if the motor 24 is not operating the blower 22 at a predetermined minimum speed sufficient to provide a certain volume rate of airflow through the cabinet 12, one or all of the heating elements 26, 28 and 30 will be prevented from operation by actuation of the interlock 56. Also, blower motor speed is continuously monitored and, if an overspeed condition exists, possibly indicating blockage of air flow into or out of cabinet 12, the interlock relay 56 may also be operated to shutoff power to the heating elements 26, 28 and 30. Still further, the status of the heaters 26, 28 and 30 may be confirmed by the status of the respective relays 66, 64 and 60. Additionally, a temperature sensor 80 may be disposed in cabinet 12 to measure system discharge air temperature from apparatus 10 and communicate a signal regarding same to microcontroller 52 by way of conductor means 82. Microcontroller 52 may be programmed such that system discharge air temperature in excess of a predetermined value, or the rate of change of discharge air temperature in excess of a predetermined value, may be effective to cause microcontroller 52 to shut off operation of the heating elements 26, 28 and 30. Such shutoff of heating elements 26, 28 and 30 may be carried out by actuation of the respective relays 66, 64 and 60 or by the interlock 56 if any one of the relays should fail.

Accordingly, a signal from the motor 24 and/or its controller 78 to microcontroller 52 determines the status of the motor, that is, energized at a selected speed or selected torque setting or deenergized. The heater power relays 60, 64 and 66 also transmit signals or otherwise communicate to the microcontroller 52 indicating their status, that is, for example, stuck or failed open, actuated to allow power to flow to the respective heating elements 26, 28 and 30 and the contact elements welded or stuck together to prevent opening a power circuit between a power source, not shown, and the respective heating elements. Still further, the interlock 56 may communicate its status via a conductor 85 to microcontroller 52 to indicate whether it is in a condition to prevent power being applied to the heating elements 26, 28 or 30 or vice versa.

If the thermostat 38 issues a call for heating, signals are sent via conductors 40, 42 or 44, or possibly all three, which will cause microprocessor 52 to transmit a signal to motor controller 78, possibly via relays 70, 72 and 74, to energize motor 24 at a selected speed. Typically, there are no on or off delays in energizing the motor 24 with respect to the signals sent to the relays 60, 64 and 66 to energize one or more of the heaters 26, 28 and 30. However, if more than one stage of electric heat demand is called by thermostat 38, relays 60, 64 and 66 may be energized at intervals of about 0.5seconds, respectively. If a signal is presented to the controller 52 only at conductor 40, motor 24 may be energized for about 0.5seconds before interlock relay 56 is closed to allow energization of the selected heating element, for example. A similar delay in signal transmission may be carried out when the call for heat has been satisfied to enable capture or transmission of residual heat from the heating elements to the circulating air.

Other modes of operation may include operation when a signal is provided on conductor 48 for continuous operation of the motor 24 and a combination of the electric heating and heat pump operation in the heating mode is initiated wherein the microcontroller 52 will effect energization of the respective heating elements and provide for operation of the heat exchanger 20 to reject heat. The controller 52 will recognize that this mode of operation requires operation of the blower 22 at the higher of the electric heat or so-called mechanical heat air flow requirements, immediately. The controller 52 is also capable of detecting a fault condition in heater interlock 56. If the heater interlock relay feedback signal via conductor 85 indicates the interlock relay contacts are closed when they should be open or if any of the relays 60, 64 and 66 signal the controller 52 that the relay contacts are closed when they should be open, such signals will cause the controller 52 to run the blower motor 24 at maximum heat speed and report a fault condition via the interface 53. Moreover, if the interlock relay 56 is stuck closed, the microcontroller 52 may ignore requests for heating, for example. Still further, anytime the microcontroller 52 should malfunction and denergize the blower motor 24, the heater interlock relay 56 is also required to interrupt power to the heating elements or heaters 26, 28 and 30.

The construction and operation of control system 10*a* for an air conditioning system in accordance with the disclosure is believed to be within the purview of one skilled in the art based on the foregoing description. Commercially available components may be utilized to provide the functions described herein. Although preferred embodiments of the disclosure have been described in detail, those skilled in the art will recognize that various substitutions and modifications may be made without departing from the scope and spirit of the appended claims.

What is claimed is:

1. A method for operating an air conditioning apparatus, said apparatus including a cabinet, an air blower including an electric blower motor for propelling air from an air inlet to an air outlet of said cabinet, and at least one electric heating element disposed in an air flowstream propelled by said blower through said cabinet, said apparatus further comprising a first temperature sensor for sensing the temperature of an enclosed space being supplied with conditioned air by said apparatus and a control system including a system controller operably connected to said first temperature sensor and to a second temperature sensor for sensing the temperature of air being discharged from said apparatus, said control system further including a heater interlock operable to prevent energization of said heating element and at least one heater relay in communication with said heater interlock, said method including the steps of:

receiving by the system controller a status signal indicating the electric blower motor is operatively running above or below a maximum or a minimum speed, respectively;

communicating by the system controller a shutoff signal instructing the heater interlock to prevent electrical power from being supplied to the at least one electrical heating element in response to the system controller receiving the status signal indicating the electric blower motor is operatively running above or below the maximum or the minimum speed, respectively;

receiving by the system controller a status signal indicating at least one of (1) the air discharge temperature measured by the second temperature sensor exceeds a predetermined value and (2) a rate of change in the air discharge temperature measured by the second temperature sensor exceeds a predetermined value; and communicating by the system controller a shutoff signal instructing one of the heater interlock and the at least one heater relay to prevent electrical power from being supplied to the at least one electrical heating element in response to the system controller receiving the status signal indicating at least one of (1) the air discharge temperature exceeds the predetermined value and (2) the rate of change in the air discharge temperature exceeds the predetermined value.

2. The method set forth in claim 1 including the step of:

causing said heater interlock to prevent energization of said heating element if said blower motor is not rotating.

3. The method set forth in claim 1 including the step of:

monitoring a status of said heater relay and causing said heater interlock to prevent energization of said electrical heating element if the status of said relay is not one commanded by said system controller.

4. The method set forth in claim 1 including the step of:

causing said heater interlock to prevent energization of said heating element if said blower motor is not rotating in a direction commanded by said system controller.

5. The method set forth in claim 1 including the step of:

causing said heater interlock to prevent energization of said heating element if said blower motor is not producing a torque commanded by said system controller.

6. The method set forth in claim 1 including the step of:

causing said heater interlock to prevent energization of said heating element if a motor control relay is not in a condition commanded by said system controller.

7. The method set forth in claim 1 including the step of:

continuously monitoring the operating speed of the motor.

8. The method set forth in claim 7 including the step of:

receiving a status signal indicative of an airflow blockage through the cabinet; and communicating by the system controller a shutoff signal instructing the heater interlock to prevent electrical power from being supplied to at least one electrical heating element selected from the plurality of electrical heating elements.

9. The method set forth in claim 1 including the step of:

detecting a controller malfunction and de-energizing the motor; and automatically preventing by the heater interlock electrical power from being supplied to the at least one electrical heating element.

10. The method set forth in claim 1 including the step of:

receiving by the system controller a signal for a combined mode of operation; and communicating by the system controller at least one control signal for effectuating the combined mode of operation, wherein the combined mode of operation includes continuous operation of the motor, energization of the at least one electrical heating element, and operation of the heat exchanger to reject heat.

11. The method set forth in claim 1 including the step of:

receiving by the system controller a fault signal indicating said heater interlock is operating in a faulty condition; and communicating by the system controller a command signal instructing said motor controller to operate said electric blower motor at a predetermined maximum speed.

12. A method for controlling operation of electrical heating elements in a heating, ventilating, and air conditioning (HVAC) system in accordance with fan operating conditions, the method comprising the steps of:

providing an HVAC system comprising an air conditioning apparatus including a cabinet, a fan including a motor for propelling air from an air inlet in the cabinet to an air outlet, a heat exchanger disposed within the cabinet between the air inlet and the fan, a plurality of electrical heating elements disposed in an airflow propelled by the fan through the cabinet, a thermostat for sensing temperature of an enclosed space being supplied with air conditioned by the HVAC system, a heater interlock operatively connected to the plurality of electrical heating elements and operable to control electrical power supplied thereto, one or more relays in communication with the plurality of electrical heating elements and the heater interlock, and a system controller operable to communicate signals for controlling operation of the HVAC system, wherein the signals being based on status signals indicative of operating conditions associated with one or more components of the HVAC system;

receiving by the system controller a status signal indicating the motor is operatively running above or below a maximum or a minimum speed, respectively;

communicating by the system controller a shutoff signal instructing the heater interlock to prevent electrical power from being supplied to at least one electrical heating element selected from the plurality of electrical heating elements in response to the system controller receiving the status signal indicating the electric blower motor is operatively running above or below the maximum or the minimum speed, respectively;

receiving a status signal indicating one of the one or more relay contacts is improperly open or closed; and communicating by the system controller a command signal to operate the motor at a maximum heat speed in response to receiving the status signal indicating one of the one or more relay contacts is improperly open or closed.

13. The method set forth in claim 12 including the step of:

causing said heater interlock to prevent energization of said heating element if said blower motor is not rotating.

14. The method set forth in claim 12 including the step of:

continuously monitoring the operating speed of the motor.

15. The method set forth in claim 14 including the step of:

receiving a status signal indicative of an airflow blockage through the cabinet; and communicating by the system controller a shutoff signal instructing the heater interlock to prevent electrical power from being supplied to at least one electrical heating element selected from the plurality of electrical heating elements.

16. The method set forth in claim 12 including the step of:

receiving by the system controller a fault signal indicating said heater interlock is operating in a faulty condition; and communicating by the system controller a command signal instructing said motor controller to operate said electric blower motor at a predetermined maximum speed.

17. The method set forth in claim 12 including the step of:

causing said heater interlock to prevent energization of said heating element if said blower motor is not rotating in a direction commanded by said system controller.

18. The method set forth in claim 12 including the step of:

causing said heater interlock to prevent energization of said heating element if a motor control relay is not in a condition commanded by said system controller.

* * * * *